US005643103A

United States Patent [19]

Aizawa

[11] Patent Number: 5,643,103

[45] Date of Patent: Jul. 1, 1997

[54] GOLF CLUB SET

[75] Inventor: Yuichi Aizawa, Tokyo, Japan

[73] Assignee: Daiwa Seiko, Inc., Tokyo, Japan

[21] Appl. No.: 622,986

[22] Filed: Mar. 27, 1996

[30] Foreign Application Priority Data

Mar. 27, 1995 [JP] Japan ..... 7-067900

[51] Int. Cl.[6] ..... A63B 53/04

[52] U.S. Cl. ..... 473/290; 473/342; 473/350

[58] Field of Search ..... 473/282, 287, 473/288, 289, 290, 291, 292, 324, 342, 350

[56] References Cited

U.S. PATENT DOCUMENTS

| | | | |
|---|---|---|---|
| 1,253,700 | 1/1918 | McLaughlin | 473/288 |
| 3,368,812 | 2/1968 | Baldwin | 473/288 |
| 4,754,969 | 7/1988 | Kobayashi | 473/290 |
| 4,884,808 | 12/1989 | Retzer | 473/288 |
| 4,884,812 | 12/1989 | Nagasaki | 473/342 |
| 5,405,136 | 4/1995 | Hardman | 473/342 |
| 5,413,336 | 5/1995 | Iwanaga | 473/291 |
| 5,423,535 | 6/1995 | Shaw | 473/342 |

FOREIGN PATENT DOCUMENTS

| | | |
|---|---|---|
| 3-19897 | 4/1991 | Japan . |
| 5-337222 | 12/1993 | Japan . |

*Primary Examiner*—Sebastiano Passaniti
*Attorney, Agent, or Firm*—Longacre & White

[57] ABSTRACT

In a golf club set, a face plate made of a material that is lower in specific gravity and elastic modulus than that of a head body of each golf club, is mounted on a face portion of the head body. The thicknesses of the face plates of the golf clubs increase in the order of the golf clubs of large club numbers to those of small club numbers. Further, a through hole may be formed through the head body of each golf club to extend from a face portion thereof to a back portion thereof. In this case, the face plate is mounted on the face portion of the head body, while closing the through hole.

7 Claims, 5 Drawing Sheets

GOLF CLUB SET

BACKGROUND OF THE INVENTION

1. Field of the Invention

The present invention relates to a golf club set.

2. Discussion of the Prior Art

Generally, the golf iron club set includes long iron clubs consisting of number two to four iron clubs, middle iron clubs consisting of number five to seven iron clubs, and short iron clubs consisting of number eight to ten iron clubs and a sand wedge.

In the head body of the iron club, a hosel portion and a face portion are integrally formed of metal such as soft iron and stainless steel. The lofts of the iron clubs increase with increase of the numbers indicative of the gradations of the iron clubs from the long iron clubs to the short ones. In the head body of this type, it is known that when the weight of the head body is distributed over the peripheral portion, a moment of inertia of the head body increases during the swing, to thereby achieve the directional stability of a ball.

Recently, there is a proposal of an iron club in which a recess is formed in the face portion of the metal head body, and a thin face plate made of a material that is lower in specific gravity than the head body, is fitted into the recess. There is another conventional iron club 7 as disclosed in Published Unexamined Japanese Patent Application No. Hei. 5-337222 or shown in FIG. 9. In the iron club, a through hole 4 is formed through a metal head body 1 to extend from a face portion 2 to a back portion 3, with its peripheral portion remaining, and a face plate 6 having a lower specific gravity than that of the head body 1 is fitted in a fitting recess 5 formed in the face portion 2.

In those conventional iron clubs, the face plate is lower in specific gravity than the head body, and therefore the weight of the head body is distributed over its peripheral portion. As a result, a moment of inertial of the head body increases during the swing, thereby achieving the directional stability of the ball.

In the iron club of the publication of Published Unexamined Japanese Patent Application No. Hei. 5-337222, the face plate 6 made of titanium or a titanium alloy is fitted into the fitting recess 5 of the head body 1 made of stainless steel or beryllium copper. Although titanium or a titanium alloy is lower in elastic modulus than soft iron or stainless, the face plate 6 must also serve as a vibration absorbing member for absorbing vibrations, developed when hitting the ball.

The manner to handle the iron club for hitting the ball is different with the numbers representative of iron clubs. The long iron club of the set is swung to hit hard a ball to secure a long flying distance. With increase of the club numbers from the long iron clubs to the middle iron clubs and the short iron clubs, the iron clubs are designed to increase the spin on the ball to more accurately land the ball at an aimed place.

Accordingly, a degree of the necessity of absorbing vibrations is also different with the club numbers. In the long iron club for hitting hard the ball, large vibrations are produced when hitting the ball. Thus, it is necessary to absorb the vibrations so as to prevent the vibrations from being transmitted to the elbows.

With increase of the club numbers of the used clubs to the middle iron clubs and the short iron clubs, the force to hit the ball becomes smaller and the degree of the necessity of absorbing the vibrations also becomes reduced. For those iron clubs, it is desirable that the absorption of the vibration is rather suppressed to leave some degree of the ball hitting feel, to thereby ease the control of the ball.

There has not been proposed yet a golf club set of the type in which the face plates of the iron clubs are different in thickness every club.

Therefore, particularly in the long iron club for hitting hard the ball, there is a possibility that vibrations generated in the iron club when hitting the ball is transmitted to the elbows, for example, in a state that it is unsatisfactorily absorbed. Further, it has been pointed out that the long iron club has a thick hitting face of the face portion, and hence a moment of inertia of the head body thereof is small, to thereby provide an unsatisfactory directional stability of the ball.

In addition, Published Examined Japanese Utility Model Application No. Hei. 3-19897 may disclose such a golf club set that a ball hitting face of the face portion becomes thinner as the club number increases from the long iron clubs to the middle iron clubs and the short iron clubs. However, the head body of each of those clubs is entirely made of the same metallic material.

SUMMARY OF THE INVENTION

The present invention has been made in view of the above problems, and an object of the present invention is to provide a golf club set in which the vibration absorbing effect is different for each of the golf clubs having their own handling manners, a good directional stability of the ball, and hence an easy control of the ball is secured for the golf clubs of the lower numbers.

To achieve the above object, there is provided a golf club set improved in that a face plate made of a material that is lower in specific gravity and elastic modulus than that of a head body of each golf club, is mounted on a face portion of the head body, and the thicknesses of the face plates of the golf clubs increase in the order of the golf clubs of large club numbers to those of small club numbers.

In the golf club set thus constructed, a through hole may be formed through the head body of each golf club to extend from a face portion thereof to a back portion thereof. In this case, the face plate is mounted on the face portion of the head body, while closing the through hole.

With the golf club set, for instance, the iron club sets, a player uses the long iron club to hit hard a ball to secure a long flying distance. To more accurately land the ball at an aimed place by increasing the spin on the ball, he changes the club to the clubs of larger club numbers, viz., to the middle and the short iron clubs. In the case of the long iron club, great vibrations, produced therein when hitting the ball, is absorbed by the thick face plate, to thereby prevent the vibrations from being transmitted to the elbows.

And besides, the face plate is made of a material that is lower in specific gravity than that of the head body 8, so that the weight of the head body 8 is distributed over the peripheral portion, and a moment of inertia increases.

With increase of the club numbers of the used clubs to the middle iron clubs and the short iron clubs, the force to hit the ball becomes smaller and the vibrations, produced when hitting the ball, also become smaller, and thus the face plates for those clubs are designed to be thinner in thickness. Therefore, the vibration absorption effects of the face plates are smaller, to thereby allow the player to feel the ball hitting with the hands.

BRIEF DESCRIPTION OF THE DRAWINGS

Other features and advantages of the invention will be apparent from the following description taken in connection with the accompanying drawings, in which.

DETAILED DESCRIPTION OF THE PREFERRED EMBODIMENTS

The preferred embodiments of the present invention will be described with reference to the accompanying drawings.

Figure 1:
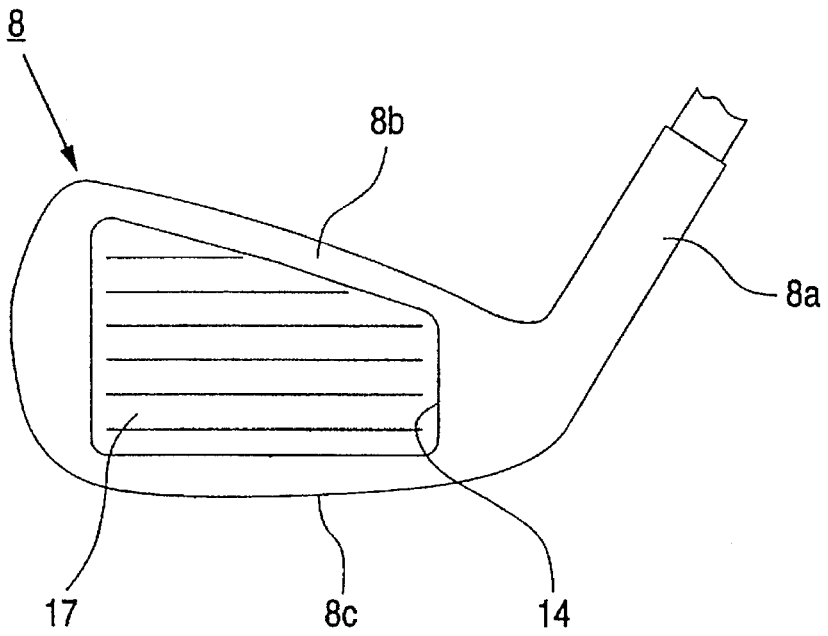
FIG. 1 is a front view of a head body of a long iron club in a golf club set according to an embodiment of the present invention.
Figure 2:
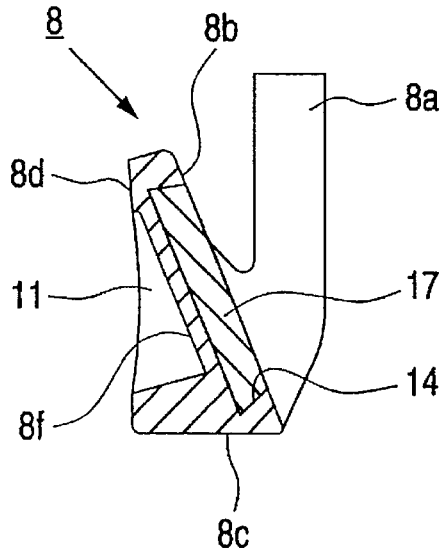
FIG. 2 is a cross sectional view of a head body shown in FIG. 1.
Figure 3:
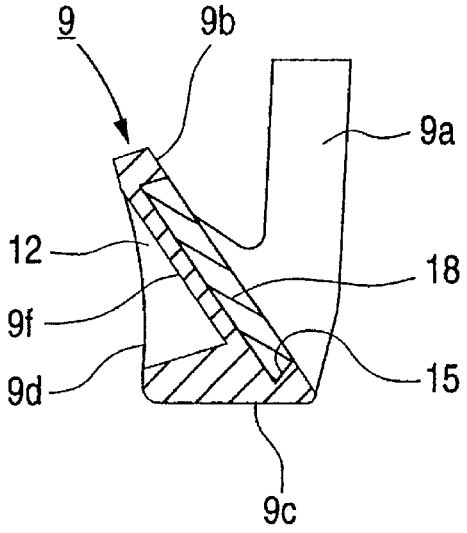
FIG. 3 is a cross sectional view of a head body of a middle iron club in the golf club set.
Figure 4:
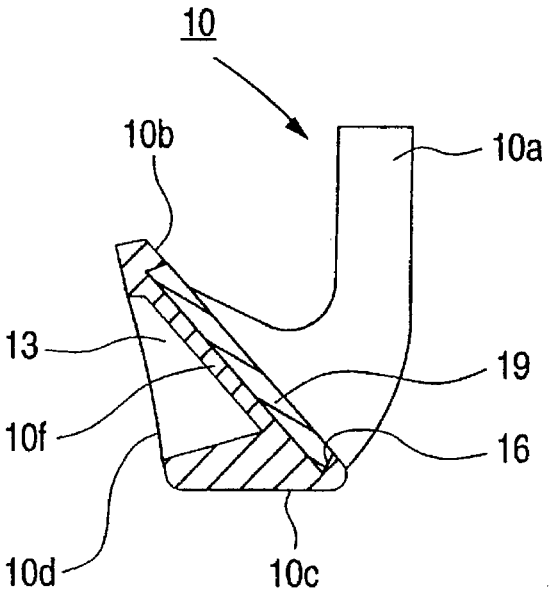
FIG. 4 is a cross sectional view of a head body of a short iron club in the golf club set.

FIGS. 1 and 2 are front and cross sectional views of a head body of a long iron club in a golf club set according to an embodiment of the present invention. FIG. 3 is a cross sectional view of a head body of a middle iron club in the golf club set, and FIG. 4 is a cross sectional view of a head body of a short iron club in the golf club set. As in the conventional golf club set, a hosel portion 8*a*, a face portion 8*b*, a sole portion 8*c*, and the like of a head body 8 of a long iron club are integrally formed of stainless steel. The same thing is correspondingly applied to those portions 9*a* and 10*a*, 9*b* and 10*b*, and 9*c* and 10*c* of the remaining iron clubs 9 and 10. The lofts of the iron clubs also increase with increase of the numbers indicative of the gradations of the iron clubs from the long iron clubs to the short ones.

A recess 11 (12, 13) is formed in a back portion 8*d* (9*d*, 10*d*) of the head body 8 (9, 10), with its peripheral portion left intact. A face plate 17 (18, 19) is fitted into a fitting recess 14 (15, 16) formed in the face portion 8*b* (9*b*, 10*b*). In the present embodiment, the face plate 17 (18, 19) is made of a material that is lower in weight and elastic modulus (Young's modulus) than the material of the head body 8 (9, 10). The thicknesses of the face plates 17 to 19 of the clubs are increased as the club numbers of the clubs decrease, viz., in the order of the short iron clubs to the middle and the long iron clubs.

The face plate 17 (18, 19) has a configuration corresponding to that of the fitting recess 14 (15, 16).

When the head body 8 (9, 10) is made of soft iron (soft steel) (Elastic modulus: 21,000 kg/mm$^2$, specific gravity: 7.8), stainless steel (Elastic modulus: 16,690 kg/mm$^2$, specific gravity: 7.7), or beryllium copper (Elastic modulus: 13,000 kg/mm$^2$, specific gravity: 8.3), the face plate 17 (18, 19) is made of aluminum (Elastic modulus: 7,500 kg/mm$^2$, specific gravity: 2.7), magnesium (Elastic modulus: 4,500 kg/mm$^2$, specific gravity: 1.7), titanium (Elastic modulus: 11,000 kg/mm$^2$, specific gravity: 4.5), fiber reinforced resin or fiber reinforced metal. When the head body 8 (9, 10) is made of titanium, the face plate 17 (18, 19) is made of aluminum, magnesium, fiber reinforced resin or fiber reinforced metal. When the head body 8 (9, 10) is made of aluminum, magnesium is preferably used for the face plate 17 (18, 19).

As described above, the face plates 17 to 19 of the clubs are thicker as the club numbers decrease, viz., in the order of the short iron clubs to the middle and the long iron clubs. When the face plate 17 (18, 19) is made of titanium, for example, the face plate 19 of the short iron club shown in FIG. 4 has a thickness of 4.0 mm, equal to that of the conventional face plate. The face plate 18 shown in FIG. 3 has a thickness of 4.25 mm, and the face plate 17 shown in FIG. 2 has a thickness of 4.5 mm. When the face plate 17 (18, 19) is made of aluminum, the face plate 19 shown in FIG. 4 has a thickness of 4.0 mm. The face plate 18 shown in FIG. 3 has a thickness of 5.0 mm, and the face plate 17 shown in FIG. 2 has a thickness of 6.0 mm.

In addition, the fitting recess 14 (15, 16) and the recess 11 (12, 13) are formed respectively in the face portion 8*b* (9*b*, 10*b*) and the back portion 8*d* (9*d*, 10*d*) of the head body 8 (9, 10), and thus the thickness of the hitting face (or supporting wall 8*f* (9*f*, 10*f*)) of the face portion 8*b* (9*b*, 10*b*) is reduced, but the hitting faces or supporting walls 8*f*, 9*f* and 10*f* of those head bodies 8 to 10 are equal to each other in thickness. The fitting recess 14 (15, 16) is so deep that the face plate 17 (18, 19), when fitted into the fitting recess 14 (15, 16), is flush with the face portion 8*b* (9*b*, 10*b*).

A player uses the iron clubs with the head bodies 8 to 10 when hitting a ball, in the following manner. He uses the long iron club to hit hard a ball to secure a long flying distance. To more accurately land the ball at an aimed place by increasing the spin on the ball, he changes the club to the clubs of larger club numbers, viz., from the long iron clubs to the middle and the short iron clubs. In the case of the long iron club of FIG. 1 for hitting hard the ball, great vibrations, produced therein when hitting the ball, is absorbed by the thick face plate 17, to thereby prevent the vibrations from being transmitted to the elbows. And besides, the face plate 17 is made of a material that is lower in specific gravity than that of the head body 8, so that the weight of the head body 8 is distributed over the peripheral portion, and a moment of inertia increases.

With increase of the club numbers of the used clubs to the middle iron clubs and the short iron clubs, the force to hit the ball becomes small and the vibrations, produced when hitting the ball, also become small, and thus the face plates 18 and 19 are decreased in thickness. Therefore, the vibration absorption effects of the face plates 18 and 19 are smaller, to thereby allow the player to feel the ball hitting with the hands.

In the set of the golf clubs having their own handling manners, the vibration absorption effect of the golf club is made different for each club number by designing the face plates 17 to 19 to have different thicknesses. With this construction, in the long iron club for hitting hard the ball, great vibrations produced when hitting the ball may be absorbed by the face plate 17. In the middle and the short iron clubs for hitting the ball not hard, the vibration absorption effect is reduced to allow the player to feel the ball hitting with the hands. As a result, an easy control of the ball is realized.

In the present embodiment, the face plate 17 is made of a material that is lower in specific gravity than that of the head body 8, so that a moment of inertia of the head body increases although the face plate 17 is thick. As a result, a good directional stability of the ball is secured.

Another embodiment of the present invention will be described with reference to FIGS. 5 to 8.

Figure 5:
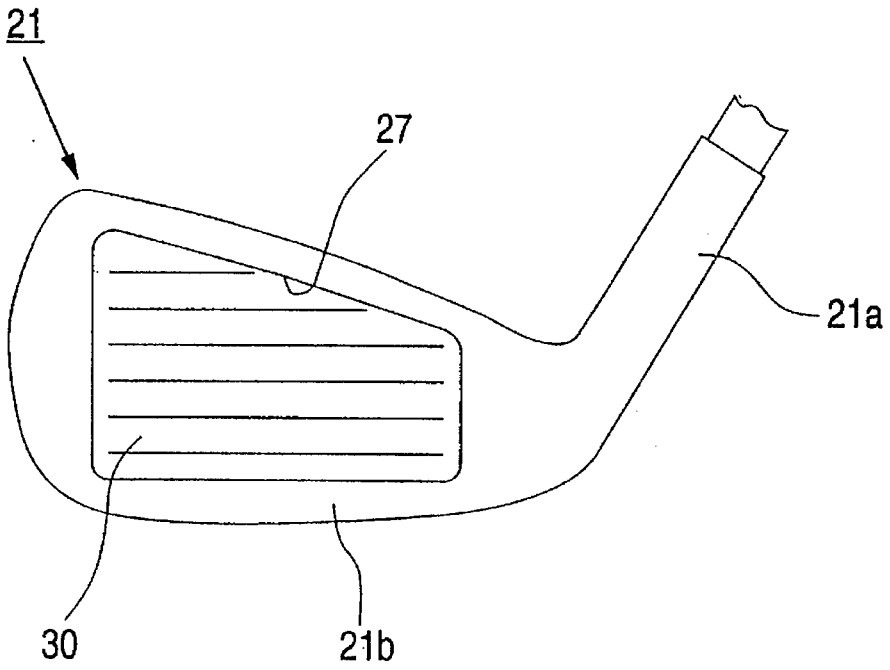
FIG. 5 is a front view of a head body of a long iron club in a golf club set according to another embodiment of the present invention.
Figure 6:
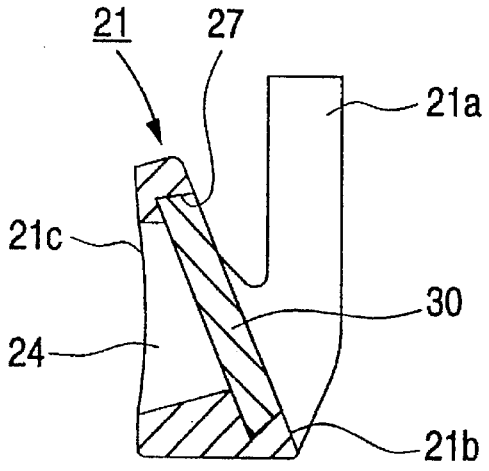
FIG. 6 is a cross sectional view of the head body shown in FIG. 5.
Figure 7:
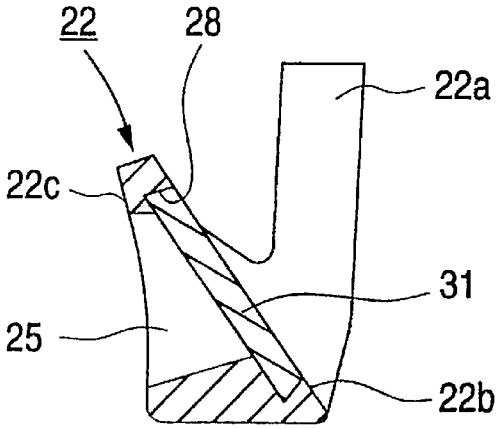
FIG. 7 is a cross sectional view of a head body of a middle iron club in the golf club set.
Figure 8:
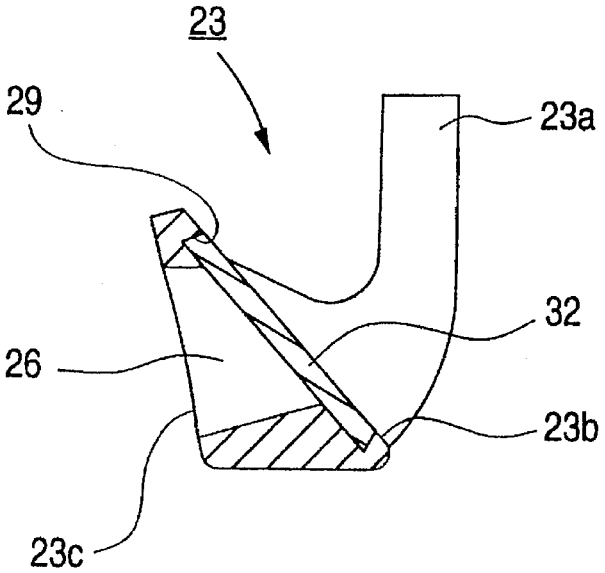
FIG. 8 is a cross sectional view of a head body of a short iron club in the golf club set.
Figure 9:
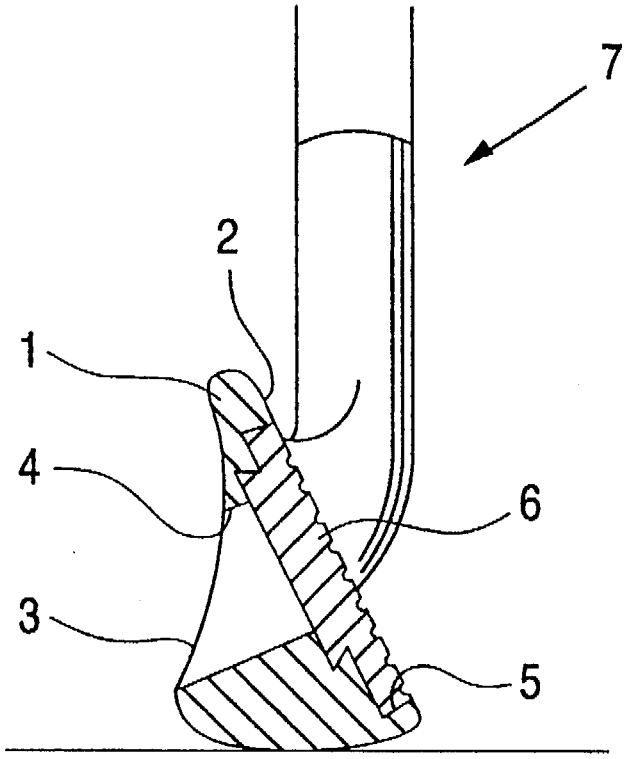
FIG. 9 is a cross sectional view of a head body of a conventional golf club.

FIGS. 5 and 6 are front and cross sectional views of a head body of a long iron club in a golf club set according to another embodiment of the present invention. FIG. 7 is a cross sectional view of a head body of a middle iron club in the golf club set, and FIG. 8 is a cross sectional view of a head body of a short iron club in the golf club set. Also in the present embodiment, a hosel portion 21*a*, a face portion 21*b*, and the like of a head body 21 of a long iron club are formed in a one-piece construction. The same thing is correspondingly applied to those portions 22*a* and 23*a*, 22*b* and 23*b* of the remaining iron clubs 22 and 23. A through hole 24 (25, 26) is formed through the head body 21 (22, 23) to extend from a face portion 21*b* (22*b*, 23*b*) to a back portion 21*c* (22*c*, 23*c*), with its peripheral portion remaining.

A face plate 30 (32, 33) is fitted into a fitting recess 27 (28, 29) that is formed in the peripheral portion of the face portion 21*b* (22*b*, 23*b*) side of the through hole 24 (25, 26), whereby the through hole 24 (25, 26) is closed. Also in the present embodiment, the head body 21 (22, 23) and the face plate 30 (32, 33) are made of the same material as in the first embodiment. When the face plate 30 (31, 32) is made of titanium, for example, the face plate 32 shown in FIG. 8 has a thickness of 4.0 mm. The face plate 31 shown in FIG. 7 has a thickness of 4.5 mm, and the face plate 30 shown in FIG. 6 has a thickness of 5.0 mm. Thus, the face plates of the clubs are thicker with decrease of the club numbers, viz., in the order of the short iron clubs to the middle and the long iron clubs.

The fitting recess 27 (28, 29) is so deep that the face plate 30 (31, 32), when fitted into the fitting recess 27 (28, 29), is flush with the face portion 21*b* (22*b*, 23*b*).

Thus, also in present embodiment, the face plate 30 (31, 32) is made of a material that is lower in specific gravity than that of the head body 21 (22, 23). Further, the face plates 30 to 32 are thicker in the order of the short iron clubs to the middle and the long iron clubs. Therefore, the present embodiment can also achieve the intended object.

Although not illustrated, it is evident that the present invention is applicable to a golf club set of called wood clubs.

As seen from the foregoing description, in the golf club set of the invention, in the clubs of small club numbers for hitting hard the ball, great vibrations produced when hitting the ball is absorbed by the face plate. In the clubs of large club numbers for hitting the ball not hard, the vibration absorption is reduced to allow the player to feel the ball hitting with the hands. As a result, an easy control of the ball is realized.

Further, in the clubs of small club numbers, a moment of inertia of the head body increases although the face plate is thick, so that a good directional stability of the ball is secured.

What is claimed is:

1. A golf club set comprising:

a plurality of golf clubs having respective club face loft angles, and each being constructed so that a separate face plate made of a material lower in specific gravity and elastic modulus than that of a head body is mounted on a face portion of the head body, and wherein the face plates of the golf clubs increase in thickness as the club face loft angles of the golf clubs decrease, and wherein said material of each said separate face plate has a specific gravity of about 20% to about 60% of the specific gravity of said head body.

2. The golf club set according to claim 1, wherein a through hole is formed through the head body of each golf club to extend from a face portion thereof to a back portion thereof, and the face plate is mounted on the face portion of the head body, while closing the through hole.

3. The golf club set according to claim 1, wherein a supporting wall is provided on the head body of each golf club to contiguously support the face plate.

4. The golf club set according to claim 3, wherein a common, constant thickness is defined for all of the supporting walls.

5. The golf club set according to claim 1, wherein when said head body is selected from a group consisting of soft iron, stainless steel and beryllium/copper, said face plate is selected from a group consisting of aluminum, magnesium and titanium.

6. The golf club set according to claim 1, wherein when said head body is titanium, said face plate is selected from a group consisting of aluminum and magnesium.

7. The golf club set according to claim 1, wherein when said head body is aluminum, said face plate is magnesium.

* * * * *